US006398360B1

(12) United States Patent
Brewington et al.

(10) Patent No.: US 6,398,360 B1
(45) Date of Patent: Jun. 4, 2002

(54) THERMAL PRINTER USING A SPLIT ROTARY PLATEN TO PRINT ON DIFFERENT WIDTHS OF PAPER

(75) Inventors: James Gabriel Brewington; Richard Hunter Harris; Jeff David Thomas, all of Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/478,245

(22) Filed: Jan. 4, 2000

(51) Int. Cl.[7] ..... B41J 2/01
(52) U.S. Cl. ..... 347/105; 400/659
(58) Field of Search ..... 347/105, 106; 400/659, 660.2, 661.3, 662, 670.2, 649, 82, 58, 585, 660.3, 650, 651

(56) References Cited

U.S. PATENT DOCUMENTS

| | | | | | |
|---|---|---|---|---|---|
| 3,880,016 | A | * | 4/1975 | Jamieson et al. | 74/405 |
| 3,915,281 | A | * | 10/1975 | Blomquiest et al. | 197/114 R |
| 4,076,112 | A | * | 2/1978 | Effinger | 197/127 R |
| 4,235,556 | A | * | 11/1980 | Dewey et al. | 400/567 |
| 4,335,971 | A | | 6/1982 | deMay, II | 400/619 |
| 4,395,152 | A | | 7/1983 | Hendrischk | 400/569 |
| 4,627,755 | A | * | 12/1986 | Moriyama et al. | 400/662 |
| 4,946,297 | A | | 8/1990 | Koike et al. | 400/82 |
| 4,981,381 | A | * | 1/1991 | Murata | 400/661 |
| 5,146,238 | A | | 9/1992 | Numabe et al. | 346/76 PH |
| 5,372,443 | A | * | 12/1994 | Boruchi, Jr. et al. | 400/649 |
| 5,923,357 | A | * | 7/1999 | Sugimoto et al. | 347/171 |

FOREIGN PATENT DOCUMENTS

| | | | |
|---|---|---|---|
| JP | 57-74183 | 5/1982 | B41J/11/04 |
| JP | 57-140177 | 8/1982 | B41J/11/02 |
| JP | 59-209894 | 11/1984 | B41J/11/48 |
| JP | 1-221267 | 9/1989 | B41J/11/02 |
| JP | 3-27958 | 2/1991 | B41J/11/02 |
| JP | 3-150180 | 6/1991 | B41J/11/14 |
| JP | 4-189165 | 7/1991 | B41J/11/48 |
| JP | 4-216972 | 8/1992 | B41J/11/51 |
| JP | 6-99621 | 4/1994 | B41J/11/04 |

* cited by examiner

*Primary Examiner*—Andrew H. Hirshfeld
*Assistant Examiner*—Darius N. Cone
(74) *Attorney, Agent, or Firm*—J. Bruce Schelkopf; Ronald V. Davidge

(57) ABSTRACT

A thermal printing station includes a split rotary platen, which is driven in rotation to move a paper web across a thermal print head held against the split rotary platen. The split rotary platen includes a motor-driven shaft, a main platen roll driven by the shaft, and a platen roll extension, which is slidable along the shaft between a first position, in which the platen roll extension is engaged with to turn with the main platen roll, and a second position, in which the platen roll extension is disengaged from the main platen roll, being allowed to remain stationary due to friction forces arising from contact with the thermal print head. The first position is used for printing on a wide paper web, while the second position is used for printing on a narrow paper web, which extends only along the main platen roll. A clip is attached to the shaft to hold the platen roll extension in the first or second position.

7 Claims, 1 Drawing Sheet

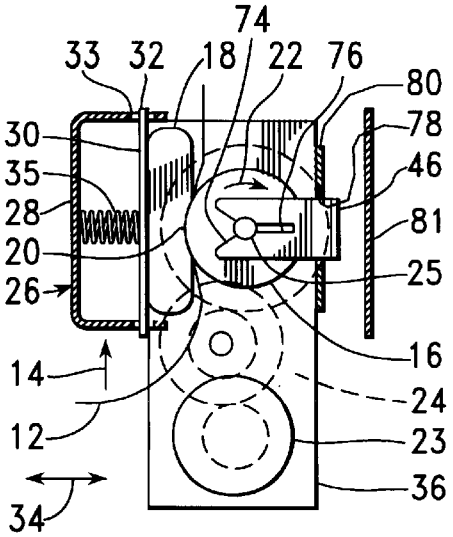
FIG. 1
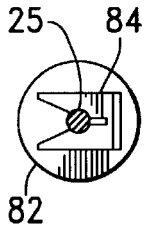
FIG. 6
FIG. 2
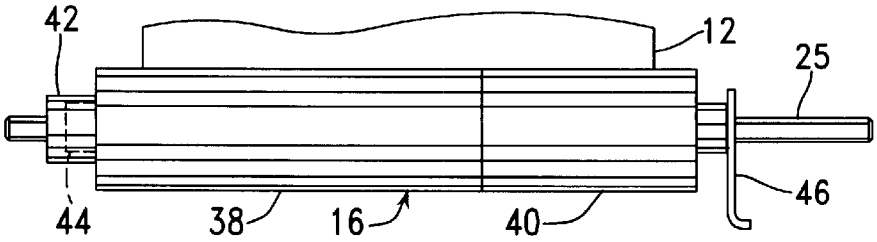
FIG. 3
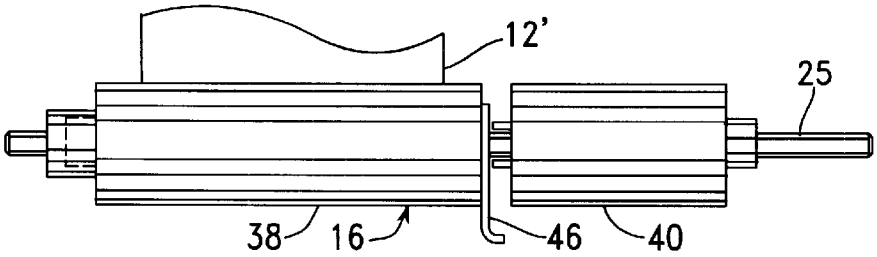
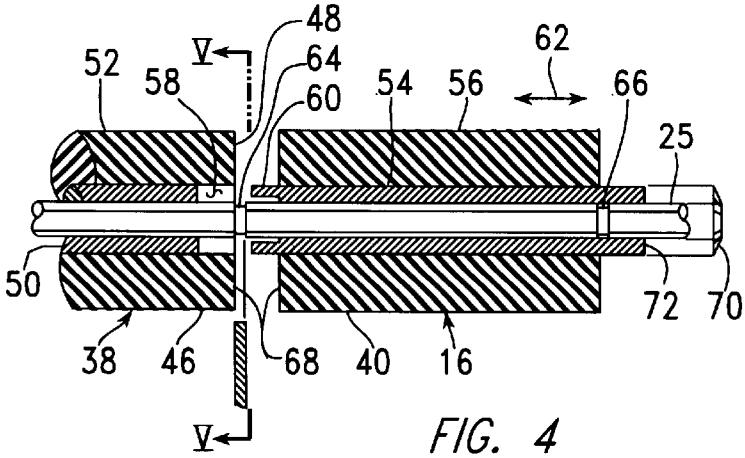
FIG. 4
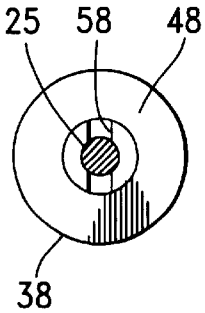
FIG. 5

THERMAL PRINTER USING A SPLIT ROTARY PLATEN TO PRINT ON DIFFERENT WIDTHS OF PAPER

BACKGROUND OF THE INVENTION

1. Field of the Invention

This invention relates to a thermal printer operable with differing widths of paper and, more particularly, to such a printer having a platen which is convertible to provide a variable width of rotating platen in accordance with the width of the paper being used.

2. Description of the Related Art

A conventional thermal printer writes on thermally-sensitive paper using a print head having a linear array of heating elements extending across the width of the paper, with the width of the paper being considered to extend in a direction perpendicular to the direction in which the paper is moved through the printer. The paper is held in intimate contact with the print head by means of a platen having an elastomeric outer layer, with the paper moving between the platen and the print head. The platen is rotated by a motor to drive the paper past the print head, with the high coefficient of friction of the elastomer relative to the paper providing a frictional force keeping the paper moving with the surface of the platen. Uniform contact pressure between the paper and the print head is obtained by holding the print head against the paper and the platen with a spring near each end of the print head.

It is desirable to build a thermal printer that can be used efficiently with two different widths of paper. Naturally, the print head and the platen must be wide enough to accommodate the wider paper. A problem associated with such a configuration arises from the fact that, when the narrower paper is used, a substantial portion of the platen rotates against the print head instead of the paper. Depending on the alignment of the narrower paper within the printer, this substantial portion of the platen may extend from one edge of the narrower paper, or this substantial portion may be divided into portions extending from each edge of the narrower paper. In either case, since the paper-moving function of the platen requires the use of an outer layer of the platen having a high coefficient of friction, when the narrower paper is used, a substantial frictional torque is developed on the platen by contact with the stationary print head instead of with the moving paper. This frictional torque increases the torque requirements on the motor driving the printer and may in fact cause this motor to operate at the wrong speed or stall. Also, this frictional torque results in wear of the print head and of the platen.

A solution for this problem is described in Japanese Publication No. 57-74183, which describes a thermal printer platen having a central section turning with a driven shaft and two outer sections, each of which extends from an end of the central section, being rotatably mounted on the shaft. When the wider paper is used, the paper extends across all three platen sections, with the paper being driven by the rotary motion of the central section, and with the outer sections in turn being driven in rotation by the linear motion of the paper. When the narrower paper is used, the paper extends only across the central section, with the paper being driven by the rotary motion of the central section, and with the outer sections remaining stationary against the print head.

Another solution for this problem is described in Japanese Publication No. 57-140177, which describes a platen having end portions coated with a low-friction material. Whether the paper is wide or narrow, it is driven by the conventional central portion. If the paper is narrow, the end portions, having low-friction surfaces, rotate easily against the print head.

Problems with the solutions described in Japanese Publication Nos. 57-74183 and 57-140177 arise from the fact that only the central portion of the wider paper is mechanically driven by the platen. Relatively high levels of friction continue to exist between the outer portions of the wider paper and the print head, so that the margin of safety for driving the paper without jamming is reduced. Furthermore, to avoid an asymmetrical pattern of forces driving the wider paper, the narrower paper is centered within the path provided for the wider paper, while in many applications it is desirable to align a left or right edge of the paper regardless of its width. An example of such applications is found in point of sale printer terminals which prepare sales receipts by cutting a web of paper after printing so that a tab remains at one end before the receipts are separated.

Another solution for the problem of printing on different widths of paper with a thermal printer is described in Japanese Publication No. 6-99621, through the insertion of members composed of material having a low coefficient of friction between the platen and the print head within the regions otherwise occupied by the wider paper when the narrower paper is used. These members may be formed as tabs inserted between the platen and the print head or as belts extending abound the platen and adjacent rollers. What is needed is a method for solving the problem which allows an easier conversion of the apparatus from one paper width to another.

Another solution for this problem is described in Japanese Publication No. 3-150180, with the problem being solved through the variation in the alignment of the print head with the platen. When the wide paper is used, the print head and the platen are aligned with one another. When the narrow paper is being used, the print head and the platen are offset so that they remain in contact through a distance sufficient to accommodate the narrow paper, with opposite end portions of the print head and the platen extending outward past this distance of contact. A disadvantage of this solution is that the required width of the printer is increased by the distance through which the platen extends beyond the print head when the apparatus is configured for printing on the narrow paper.

Yet another solution for this problem is described in Japanese Publication No. 3-27958, which describes a turret having four platens. When a different width of paper is to be used, the turret is rotated to bring a correspondingly long platen into contact with the print head. Disadvantages of this solution arise from the fact that substantial space must be provided within the printer for the turret, that the cost of the printer is increased by the need to provide several platens, and that the rotational drive of the platen must be provided with a capability of engaging and disengaging the various platens as they are brought into place.

Japanese publication No. 4-189-65 describes the use of a pair of spring clutches to actuate the independent rotation of two separate platens on a rotating shaft. These rollers are spread apart, with the spring clutches disposed between them, so that they cannot be used with a single wide paper web, but so that they can readily be used with separate paper webs. A problem with alternatively using such clutches to feed a single wide web of paper with two or more coaxial clutched rollers arises from the fact that such clutches may slip differently, causing the paper to jam as it is fed unevenly.

BRIEF SUMMARY OF THE INVENTION

According to a first aspect of the present invention, there is provided a printing station for printing alternately on a wide paper web and a narrow paper web, in which the printing station includes a split rotary platen, a motor driving a shaft of the split rotary platen, and a print head held against the split rotary platen. The split rotary platen includes the shaft, a main platen roll, attached to turn with the shaft, and a platen roll extension, slidable on the shaft between a first position, in which said platen roll extension engages the main platen roll to turn with the main platen roll, and a second position, in which the platen roll extension is disengaged with the main platen roll and rotatable on the shaft. The split platen roll is longer than a width of the wide paper web. The main platen roll is shorter than the wide paper web, but longer than the narrow paper web.

BRIEF DESCRIPTION OF THE SEVERAL VIEWS OF THE DRAWINGS

FIG. 1 is a left cross-sectional elevation of a printing station built in accordance with the present invention;

FIG. 2 is a plan view of a split platen used in the printing station of FIG. 1, configured for printing on a wide paper web;

FIG. 3 is a plan view of the split platen of FIG. 2, configured for printing on a narrow paper web;

FIG. 4 is a fragmentary longitudinal cross-sectional view of the split platen of FIG. 3;

FIG. 5 is a transverse cross-sectional view of the split platen of FIG. 4, taken as indicated by section lines V—V therein; and FIG. 6 is a left elevation of a alternate version of a split platen for use in the printing station of FIG. 1.

DETAILED DESCRIPTION OF THE INVENTION

FIG. 1 is a left cross-sectional elevation of a printing station 10 built in accordance with the present invention, in which a thermally-sensitive web 12 of paper is fed upward, in the direction of arrow 14, between a split platen 16 and a thermal print head 18, which includes a linear array of heating elements 20. The paper web 12 is moved through the printing station 10 by the rotation of the split platen 16 in the direction of arrow 22, with at least a part of the split platen 16 being rotationally driven by a motor 23 through a gear train 24 and through the platen shaft 25.

A frame 26 associated with the printing station 10 includes a channel 28 mounting a plate 30 to which the print head 18 is attached. The print head 18 is resiliently mounted, with tabs 32 of the mounting plate 30 extending through slots 33 within the channel 28 to allow movement of the print head 18 in the directions of arrow 34, and with a compression spring 35 near each end of the print head 18 holding the print head 18 against the adjacent surface of the split platen 16. The frame 26 also includes a pair of sideplates 36 extending from the channel 28 to mount the shaft 25 in a rotatable manner.

FIG. 2 is a plan view of the split platen 16 of the printing station 10, shown in as configured to print on a relatively wide paper web 12. The split platen 16 includes a main platen roll 38 and a platen roll extension 40, which are together large enough to accommodate the relatively wide paper web 12. The main platen roll 38 is rigidly connected to the shaft 25 by means of a collet 42, which is rigidly attached to both the shaft 25 and to a hub 44 of the main platen roll 38. In the example of FIG. 2, the platen roll extension 40 is held in place against the main platen roll 38 by means of a clip 46 fastened on the shaft 25 in an inner location. In this configuration, the entire split platen 16 is rotated to move the entire width of the paper web 12.

FIG. 3 is a plan view of the split platen 16 of the printing station 10, shown as configured to print on a relatively narrow paper web 12', with the platen roll extension 40 being held away from the main platen roll 38 by means of the clip 46 fastened on the shaft 25 in an outer location. In this configuration, the main platen roll 38 is rotated to move the entire width of the narrow paper 12', while the platen roll extension 40 remains stationary, due to frictional forces between the print head 18 and the platen roll extension 40.

FIG. 4 is a fragmentary longitudinal cross-sectional elevation of the split platen 16, shown in an exploded relationship with the clip 46, showing details of the construction of the split platen 16, and FIG. 5 is a transverse cross-sectional elevation of the split platen 16, taken as indicated by section lines V—V in FIG. 4 to show an internal end 48 of the main platen roll 38.

Referring to FIGS. 4 and 5, the main platen roll 38 includes a metal core 50, over which an elastomeric layer 52 is molded. Similarly, the platen roll extension 40 includes a metal core 54, over which an elastomeric layer 56 is molded. The elastomeric layers 52, 56 are preferably composed of a urethane material providing a high coefficient of friction with respect to paper for reliably moving the paper web 12 or 12'. The metal core 50 of the main platen roll 38 includes a pair of diametrically opposed slots 58, which are engaged by a matching pair of tabs 60 extending from the metal platen 54 of the platen roll extension 40, when the platen roll extension 40 is moved in the direction of arrow 62 into engagement with the main platen roll 38.

Continuing to refer to FIGS. 4 and 5, and additionally referring to FIG. 1, the shaft 25 includes an inner groove 64 defining a position in which the clip 46 is slid, with the platen roll extension 40 slid opposite the direction of arrow 62 to be disengaged from the main platen roll 38, to leave the split platen 16 in the configuration of FIG. 3 for printing on the narrow paper web 12'. With the clip 46 engaging the inner groove 64, the clip 46 is interposed between the tabs 60 and the grooves 58, so that the platen roll extension 40 cannot be engaged with the main platen roll 38.

The shaft 25 also includes an outer groove 66 defining a position in which the clip 46 is slid to leave the split platen 16 in the configuration of FIG. 2 for printing on the wide paper web 12. With the clip 46 engaging the outer groove 66, after the platen roll extension 40 is slid in the direction of arrow 62 into full engagement with the main platen roll 38, the platen roll extension 40 is held against the main platen roll 38, so that the platen roll extension 40 turns with the main platen roll 38. In this condition the elastomeric layer 56 of the platen roll extension 40 is preferably held in contact with the elastomeric layer 52 of the main platen roll 38, preventing a gap which would otherwise affect local print quality. This type of contact may be assured by relying on the accuracy of the location of the outer slot 66 relative to the internal end 48 of the main platen roll 38, by allowing the adjacent, inner end surface 68 of either or both of the elastomeric layers 52, 56 to overextend the core 50, 54 within. Alternately, a resilient element, such as a Belleville washer 70 may be placed on the hub portion 72 of the core 54, to be held in compression by the clip 46 in the outer slot 66.

Continuing to refer to FIG. 1, the clip 46 includes a tapered opening 74 facilitating placement of the clip 46 into either of the slots 64, 66 in the shaft, and a clip slot 76 providing flexibility to allow the clip 46 to expand as it is pressed over the shaft 25. The clip 46, whether in the position of FIG. 2 or the position of FIG. 3 is supported within a slot 78 within a clip support fixture 80 extending between the sideplates 36. The printing station 10 is preferably disposed near a system cover 81, which is easily opened or removed to facilitate the removal of the clip from one of the slots 64, 66 and its placement in the other slot 64, 65 when the width of the paper web being printed is changed.

FIG. 6 is a left end view of an alternate version of a thermal printer platen 82 built in accordance with the present invention. This platen 82 differs from the previously described version in that a clip 84 is configured to be smaller than the diameter of the elastomeric layers 86 of the platen 82. With this alternate version, there is no need to provide an element, such as the clip support fixture 80 of FIG. 1, for holding the clip 84, which is instead allowed to rotate with the shaft 25, or to remain stationary with a stationary roll on the turning shaft 25.

Referring to FIGS. 2 and 3, advantages are achieved over the prior art devices in to which only a portion of the wider paper is driven, as described, for example, in Japanese Publication Nos. 57-74183 and 57-140177. In the printer 10, the entire width of the wide paper is driven by the platen, so there is no need to drive the paper in a symmetrical pattern. Thus, the left edges 88, 90 of the wide paper web 12 and the narrow paper web 12', respectively, as driven through the printing station 10 are aligned with one another. The paper web 12, 12' is preferably located by means of edge guides determining a position of a supply roll (not shown) from which the paper web 12, 12' is drawn, and/or determining the position of the paper web 12, 12' after it is drawn from the supply roll. Therefore, a knife system can easily be arranged to cut both the wider paper web 12 and the narrow paper web 12' in a manner leaving similar connecting tabs of paper at each cut line, facilitating the subsequent separation of the paper web into individual record documents.

While the invention has been described in its preferred forms or embodiments with some degree of particularity, it is understood that this description has been given only by way of example, and that numerous changes in the details of construction, fabrication, and use, including changes in the combination and arrangement of parts, may be made without departing from the spirit and scope of the invention.

What is claimed is:

1. A printing station for printing alternately on a wide paper web and a narrow paper web, wherein said printing station comprises:

a clip;

a split rotary platen including a shaft, a main platen roll, including a first core and a first elastomeric layer extending around said first core, wherein said main platen roll is attached to turn with said shaft, and a platen roll extension, including a second core and a second elastomeric layer extending around said second core, wherein said platen roll extension is slidable on said shaft between a first position in which said platen roll extension engages said main platen roll, to turn with said main platen roll, and a second position in which said platen roll extension is disengaged with said main platen roll and rotatable on said shaft, said split rotary platen is longer than a width of said wide paper web, wherein said main platen roll is shorter that said width of said wide paper web, and wherein said main platen roll is longer than a width of said narrow paper web, said shaft includes first and second slots for holding said clip in engagement with said shaft, said first slot is positioned to hold said clip between said main platen roll and said platen roll extension in said second position, and said second slot is positioned to hold said platen roll extension in said first position, in engagement with said main platen roll;

a motor driving said shaft in rotation; and a print head held against said split rotary platen, wherein said print head includes an array of elements for forming printed images on said wide paper and on said narrow paper web driven between said split rotary platen and said print head.

2. The printing station of claim 1, additionally comprising a structure restraining rotation of said clip within said first and second slots with said shaft.

3. The printing station of claim 1 wherein said clip in said first and second positions is entirely enclosed within a diameter of said main platen roll, extending around said clip.

4. The printing station of claim 1, wherein said first core has a cavity, said second core has a tab extending toward said main platen roll, and said tab extends within said cavity when said platen roll extension is in said first position.

5. A split rotary platen for printing alternately on a wide paper web and a narrow paper web, wherein said split rotary platen comprises:

a clip;

a main platen roll attached to turn with said shaft, including a first core and a first elastomeric layer extending around said first core, wherein said main platen roll is longer than a width of said narrow paper web and shorter than a width of said wide paper web;

a platen roll extension, including a second core and a second elastomeric layer extending around said second core, wherein said platen roll extension is slidable on said shaft between a first position in which said platen roll extension engages said main platen roll to turn with said main platen roll and a second position in which said platen roll extension is disengaged with said main platen roll and rotatable on said shaft, wherein said split rotary platen is wider than a width of said wide paper web;

wherein said shaft includes first and second slots for holding said clip in engagement with said shaft, wherein said first slot is positioned to hold said clip between said main platen roll and said platen roll extension in said second position, and wherein said second slot is positioned to hold said platen roll extension in said first position, in engagement with main platen roll.

6. The split rotary platen of claim 5 wherein said clip in said first and second positions is entirely enclosed within a diameter of said main platen roll, extending around said clip.

7. The split rotary platen of claim 5, wherein said first core has a cavity, said second core has a tab extending toward said main platen roll and a second elastomeric layer extending around said second core and said tab extends within said cavity when said platen roll extension is in said first position.

* * * * *